US007320375B2

(12) United States Patent
Singh

(10) Patent No.: US 7,320,375 B2
(45) Date of Patent: Jan. 22, 2008

(54) SPLIT CONE BIT

(75) Inventor: Amardeep Singh, Houston, TX (US)

(73) Assignee: Smith International, Inc., Houston, TX (US)

( * ) Notice: Subject to any disclaimer, the term of this patent is extended or adjusted under 35 U.S.C. 154(b) by 192 days.

(21) Appl. No.: 11/184,719

(22) Filed: Jul. 19, 2005

(65) Prior Publication Data

US 2007/0017709 A1 Jan. 25, 2007

(51) Int. Cl.
*E21B 10/25* (2006.01)

(52) U.S. Cl. ..... 175/365; 175/369; 175/371; 175/331

(58) Field of Classification Search ..... 175/331, 175/315, 316, 350, 353, 355, 358, 365, 369, 175/376, 401, 359, 371
See application file for complete search history.

(56) References Cited

U.S. PATENT DOCUMENTS

| | | | | |
|---|---|---|---|---|
| 930,758 | A | 8/1909 | Hughes | |
| 1,195,208 | A | 8/1916 | Griffin | |
| 1,337,913 | A | 4/1920 | Humason | |
| 1,792,927 | A | 2/1931 | Reed | |
| 1,847,981 | A * | 3/1932 | Reed | 175/369 |
| 1,867,545 | A | 7/1932 | Akeyson | |
| 1,874,041 | A | 8/1932 | Hampton | |
| 2,044,549 | A | 6/1936 | Scott | |
| 2,047,110 | A | 7/1936 | Reed | |
| 2,047,112 | A | 7/1936 | Reed | |
| 2,047,115 | A | 7/1936 | Reed | |
| 2,047,116 | A | 7/1936 | Reed | |
| 2,133,022 | A | 10/1938 | Fisher | |
| 2,234,197 | A | 3/1941 | Reed | |
| 2,234,198 | A | 3/1941 | Reed | |
| 2,704,204 | A | 3/1955 | Koontz | |
| 2,887,301 | A | 5/1959 | Day | |
| 3,094,177 | A | 6/1963 | Williams, III et al. | |
| 4,610,317 | A | 9/1986 | England et al. | |
| 4,790,397 | A | 12/1988 | Kaalstad et al. | |
| 4,832,143 | A | 5/1989 | Kaalstad et al. | |
| 6,167,975 | B1 | 1/2001 | Estes | |
| 6,516,293 | B1 | 2/2003 | Huang et al. | |
| 6,719,073 | B2 | 4/2004 | Xiang et al. | |
| 6,785,641 | B1 | 8/2004 | Huang | |
| 6,873,947 | B1 | 3/2005 | Huang et al. | |
| 2004/0143427 | A1 | 7/2004 | Huang et al. | |
| 2004/0211596 | A1 | 10/2004 | Huang | |
| 2005/0010382 | A1 | 1/2005 | Oliver et al. | |
| 2005/0096847 | A1 | 5/2005 | Huang | |
| 2005/0133272 | A1 | 6/2005 | Huang et al. | |

* cited by examiner

*Primary Examiner*—Kenneth Thompson
(74) *Attorney, Agent, or Firm*—Osha Liang LLP

(57) ABSTRACT

A roller cone drill bit and a method for designing thereof. The roller cone drill bit includes a bit body configured to be coupled to a drill string and a journal depending from the bit body. A split roller cone is rotatably attached to the journal. The split roller cone includes an upper section and a lower section. The upper section has a plurality of cutting elements disposed at selected positions thereon. The lower section has a plurality of cutting elements disposed at selected positions thereon. The lower section is able to rotate independently of the upper section.

19 Claims, 4 Drawing Sheets

SPLIT CONE BIT

BACKGROUND OF INVENTION

Roller cone bits, variously referred to as rock bits or drill bits, are used in earth drilling applications. Typically, they are used in petroleum or mining operations where the cost of drilling is significantly affected by the rate that the drill bits penetrate the various types of subterranean formations. That rate is referred to as rate of penetration ("ROP"), and is typically measured in feet per hour. There is a continual effort to optimize the design of drill bits to more rapidly drill specific formations so as to reduce these drilling costs.

Roller cone bits are characterized by having roller cones rotatably mounted on legs of a bit body. Each roller cone has an arrangement of cutting elements attached to or formed integrally with the roller cone. The most common type of roller cone drill bit is a three-cone bit, with three roller cones attached at the end of the drill bit. A prior art three-cone bit is shown in FIG. 4. The three-cone bit 40 includes a threaded connection 14 that enables the drill bit 1 to be connected to a drill string (not shown). The three-cone drill bit 40 also includes a bit body 16 having three legs 41 extending therefrom. A roller cone 20 is rotatably mounted on a journal (not shown) extending from each of the three legs 41.

When drilling smaller boreholes with smaller bits, the radial bearings in three-cone drill bits become too small to support the weight on the bit that is required to attain the desired rate of penetration. In those cases, a two-cone or a single cone drill bit is desirable. A single cone drill bit has a larger roller cone than the roller cones on a similarly sized three-cone bit. As a result, a single cone bit has bearings that are significantly larger that those on a three cone bit with the same drill diameter.

FIG. 1A shows a prior art single cone drill bit. The single cone bit 1 includes one roller cone 4 rotatably attached to a bit body 16 such that the cone's drill diameter is concentric with the axis of rotation 6 of the bit 1. The roller cone 4 has a hemispherical shape and typically drills out a bowl shaped bottom hole geometry. The drill bit 1 includes a threaded connection 14 that enables the drill bit 1 to be connected to a drill string (not shown). The male connection shown in FIG. 1A is also called a "pin" connection. A typical single cone bit is disclosed in U.S. Pat. No. 6,167,975, issued to Estes.

FIG. 1B shows a cross section of a prior art drill bit 1 drilling a bore hole 3 in an earth formation 2. The roller cone 4 is rotatably mounted on a journal 5 that is connected to the bit body 16. The work of the roller cone 4 breaks down into two general portions: a bottom contact zone 18 and a wall contact zone 17. Cutting elements 20 on the bottom contact zone 18 portion of roller cone 4 lead the cutting of the bore hole 3 by cutting at the distal end of the drill bit 1. Cutting elements 20 in the wall contact zone 17 ream the wall of the bore hole 3 to the full diameter of the drill bit 1.

Single cone drill bits sometimes experience difficulty while drilling through changes in the earth formation, such as when a "stringer" is encountered. A "stringer" refers to a relatively small portion of harder earth formation, such as a section of sedimentary rock, encountered within a relatively softer formation. A problem that is sometimes encountered with hard stringers is that the single cone drill bit will pivot based on the indentation of the lowermost inserts in the bottom contact zone. Because the roller cone is a unitary structure, the inserts in the wall contact zone are unable to continue cutting. This can cause the single cone drill bit to hang up and stall when it encounters a stringer while drilling. Excessive scraping action and limited crushing of the stringer by the inserts in the bottom contact zone of roller cone are thought to be causes of the single cone drill bit getting hung up by a stringer. Although this issue is especially prevalent in single cone drill bits, multiple roller cone drill bits (e.g. two cone and three cone drill bits) can experience similar difficulties in drilling into stringers.

In light of the difficulties in drilling stringers and other hard formations with prior art roller cone drill bits, and especially single cone drill bits, what is still needed, therefore, are improved roller cones that are suited to drill stringers and other hard formations.

SUMMARY OF INVENTION

In one aspect, the present invention relates to a roller cone drill bit. The roller cone drill bit includes a bit body configured to be coupled to a drill string and a journal depending from the bit body. A split roller cone is rotatably attached to the journal. The split roller cone includes an upper section and a lower section. The upper section has a plurality of cutting elements disposed at selected positions thereon. The lower section has a plurality of cutting elements disposed at selected positions thereon. The lower section is able to rotate independently of the upper section.

In another aspect, the present invention relates to a method of designing a roller cone drill bit. The method includes identifying a wall contact zone and a bottom contact zone of the roller cone drill bit. The roller cone drill bit includes a bit body configured to be coupled to a drill string and a journal depending from the bit body. A split roller cone is rotatably attached to the journal. The split roller cone includes an upper section and a lower section. The upper section has a plurality of cutting elements disposed at selected positions thereon. The lower section has a plurality of cutting elements disposed at selected positions thereon. The lower section is able to rotate independently of the upper section. The method further includes locating an intersection of the upper section and the lower section such that all of a plurality of cutting elements disposed on the upper section cut in the wall contact zone of the split roller cone.

Other aspects and advantages of the invention will be apparent from the following description and the appended claims.

DETAILED DESCRIPTION

In one or more embodiments, the present invention relates to a drill bit having a at least one roller cone divided into two or more sections. More specifically, the two or more sections of the at least one roller cone are able to rotate relative to each other while drilling an earth formation.

In this disclosure, "rotatably mounted" means that the roller cone is axially constrained on the journal, but able to freely rotate.

Figure 2:
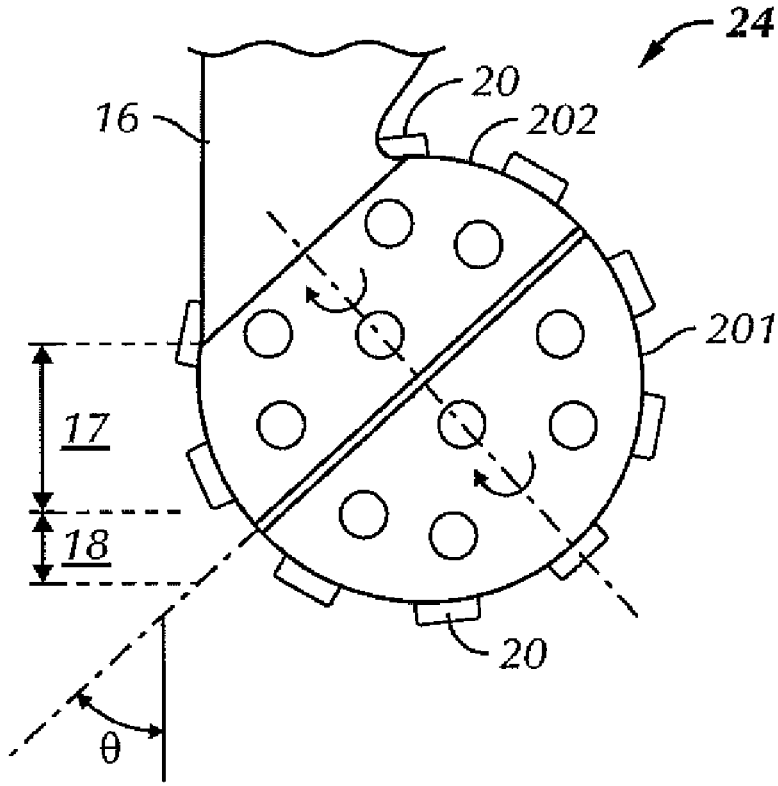
FIG. 2 shows a split roller cone in accordance with one embodiment of the present invention.

FIG. 2 shows a portion of a single cone drill bit in accordance with an embodiment of the present invention. The single cone drill bit shown in FIG. 2 includes a bit body 16 having a journal (not shown), on which a split roller cone 24 is rotatably mounted. The split roller cone 24 is generally hemispherical and split into two sections, a bottom section 201 and an upper section 202. The lower section 201 and the upper section 202 are able to rotate relative to each other, in addition to rotating about the journal. An arrangement of cutting elements is attached to or formed integrally with each of the lower section 201 and the upper section 202.

Figure 1A:
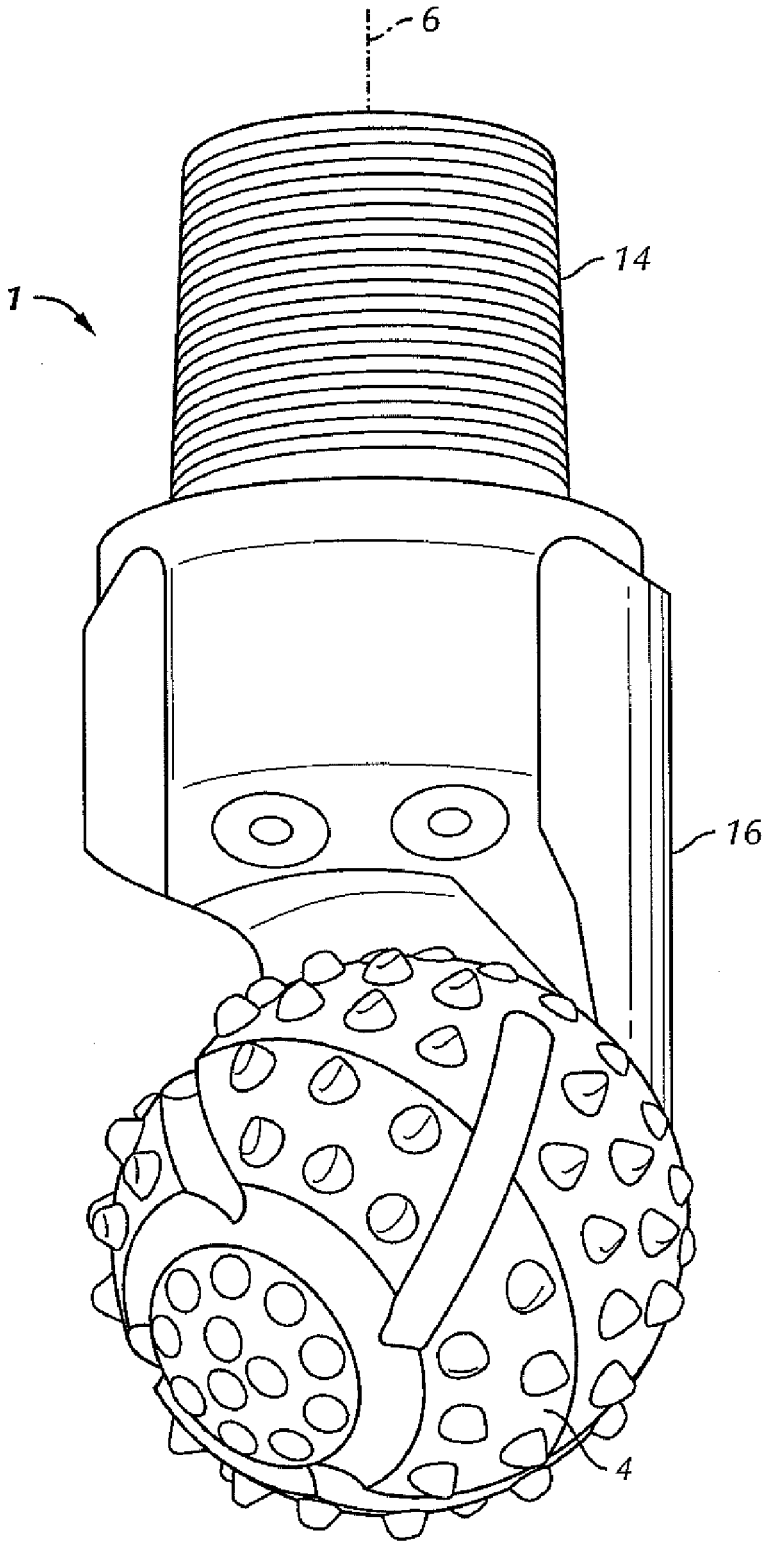
FIG. 1A (Prior Art)
FIG. 1A shows a prior art single cone drill bit.
Figure 1B:
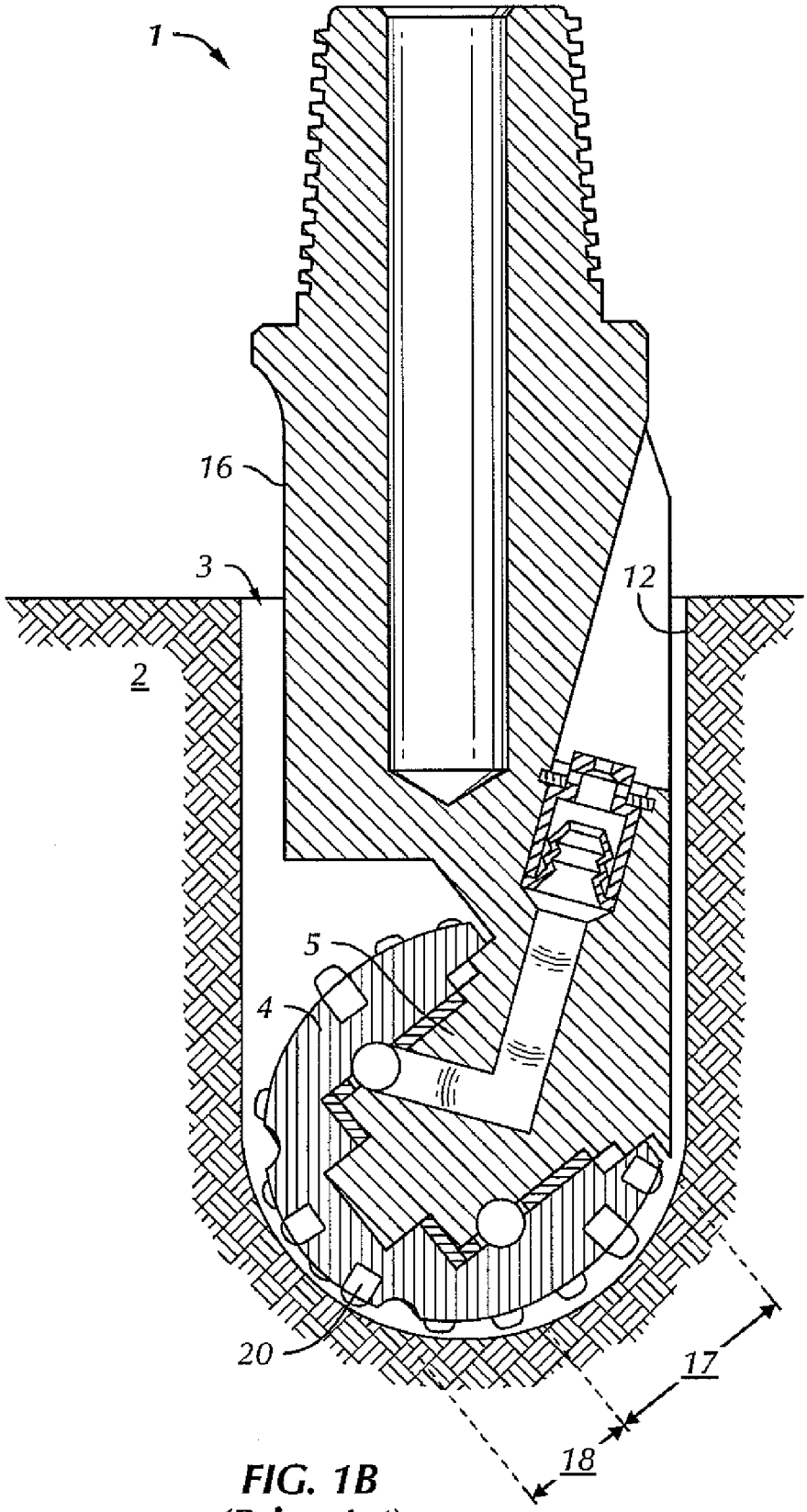
FIG. 1B (Prior Art)
FIG. 1B shows a cross section of a prior art single cone drill bit.

As discussed above with respect to FIG. 1B, the work of a roller cone 4 of a single cone drill bit generally breaks down into a bottom contact zone 18, which cuts the hole bottom, and the wall contact zone 17, which increases the diameter of the well bore to the gage diameter of the single cone drill bit. At times, in particular when drilling into a stringer, the bottom contact zone 18 and the wall contact zone 17 experience different cutting forces due to the interaction of their respective cutting elements 20 with earth formation having a variance in strength. In prior art single cone drill bits, the roller cone 4 may stop rotating and stall as the cutting elements 20 in the bottom contact zone 18 encounter difficulty in cutting and prevent the rest of the roller cone 4 from rotating. One solution proposed by the present inventors is to divide the roller cone 4 into two or more sections, as shown in FIG. 2.

In one embodiment, the lower section 201 corresponds with the bottom contact zone 18, while the upper section 202 corresponds with the wall contact zone 17. By allowing the upper section 202 to rotate relative to the lower section 201, the upper section 202 is able to continue rotating should the lower section 201 have difficulty cutting into a stringer. As the single cone drill bit continues to rotate, the lower section 201 will be forced to start rotating because of the journal angle θ, which will allow the single cone drill bit to continue drilling the stringer.

In one embodiment, the cutting elements 20 on the lower section 201 may be arranged to cut all of the bottom contact zone 18 and a portion of the wall contact zone 17, while all of the cutting elements 20 on the upper section 202 are arranged to only cut the wall contact zone 17. In this particular embodiment, if some of the cutting elements 20 on the lower section 201 begin to scrape the hole bottom without crushing or turning, other cutting elements 20 on the lower section 201 may engage with the hole wall, causing the lower section 201 to turn rather than pivot about the cutting elements 20 contacting the hole bottom.

In one embodiment, the split roller cone may include one or more intermediate sections disposed between the upper section and the lower section. In one embodiment, the split roller cone may be divided by rows of cutting elements instead of cutting zones. Further, the sections of the split roller cone need not be equal in size. Although in some embodiments the upper section and the lower section are each about 50 percent of the split roller cone, in other embodiments the split roller cone may be about 60 percent lower section and about 40 percent upper section, or vice versa. The relative size of the sections of the split roller cone is not intended to be a limitation of the present invention.

Although the embodiment shown in FIG. 2 is a single roller cone drill bit, some of the benefits of a split roller cone may also be achieved in two-cone bits and three-cone bits. Accordingly, the present invention is not limited to single cone drill bits.

Figure 3:
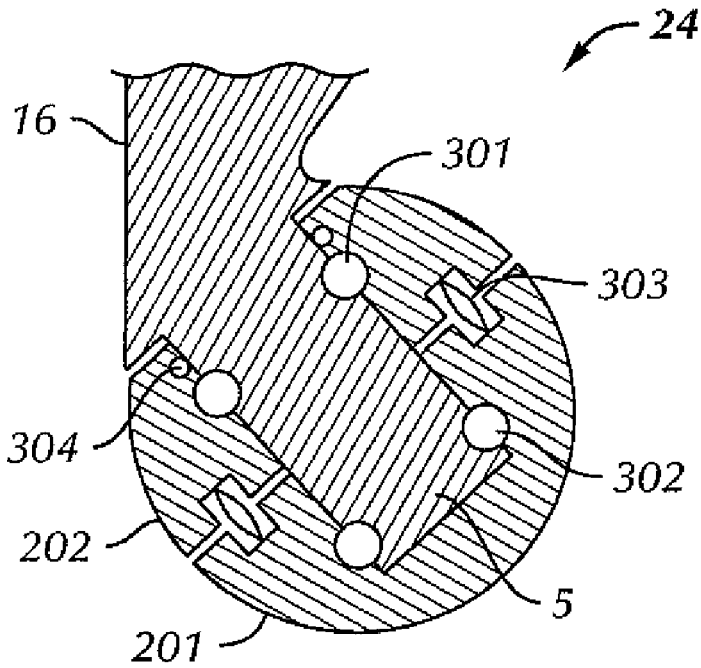
FIG. 3 shows a cross section of a split roller cone in accordance with one embodiment of the present invention.

Turning to FIG. 3, a cross section of a split roller cone 24 in accordance with an embodiment of the present invention is shown. To simplify FIG. 3, no cutting elements are shown. The split roller cone 24 includes a lower section 201 and an upper section 202, both rotatably mounted on a journal 5 attached to a bit body 16. In this embodiment, both the upper section 202 and the lower section 201 are independently retained on the journal with locking mechanisms 301 and 302, respectively. In another embodiment, only the locking mechanism 302 may be used to retain both the lower section 302, thereby axially retaining upper section 202. In some embodiments, the locking mechanisms 301 and 302 may be retaining or locking balls disposed in corresponding grooves or races on the outer surface of the journal 5 and on the interior surfaces of the upper section 202 and the lower section 201. Locking balls are only one example of a locking mechanism to rotatably mount the split roller cone 24 on the journal 5. The particular locking mechanism 301 or 302 is not meant to limit the scope of the present invention.

The lower section 201 and the upper section 202 of the split roller cone 24 is formed from steel or other high strength material, and may, in some embodiments, be covered about their exterior surfaces with hardfacing or similar coating intended to reduce abrasive wear of the split roller cone 24. In some embodiments, the split roller cone 24 may include a seal 303 disposed between the lower section 201 and the upper section 202 to exclude fluid and debris from entering the junction of the lower section 201 and the upper section 202 and the space between the inside of the split roller cone 24 and the journal 5. In one embodiment, a seal 304 may be disposed in the upper section 202 to further exclude fluid and debris from entering the space between the inside of the split roller cone 24 and the journal 5. Such seals are well known in the art, and the particular seal(s) used are not intended to limit the scope of the present invention. Further, grooves may be machined into surfaces onto either or both the upper section 202 or lower section 201 to provide a fluid "passageway" that moves the fluid away from the junction.

In one embodiment, different cutting element types may be used in the lower section 201 and the upper section 202, to improve the drilling performance of the split cone bit. For example, PDC cutting elements may be brazed into pockets on the upper or lower surfaces 201, 202. In other embodiments, only portions of the upper portion 202 and lower section 201 may be coated with a hardfacing material. In yet other embodiments, either or both of the upper section 202 and lower section 201 may be formed from diamond impregnated material.

Figure 4:
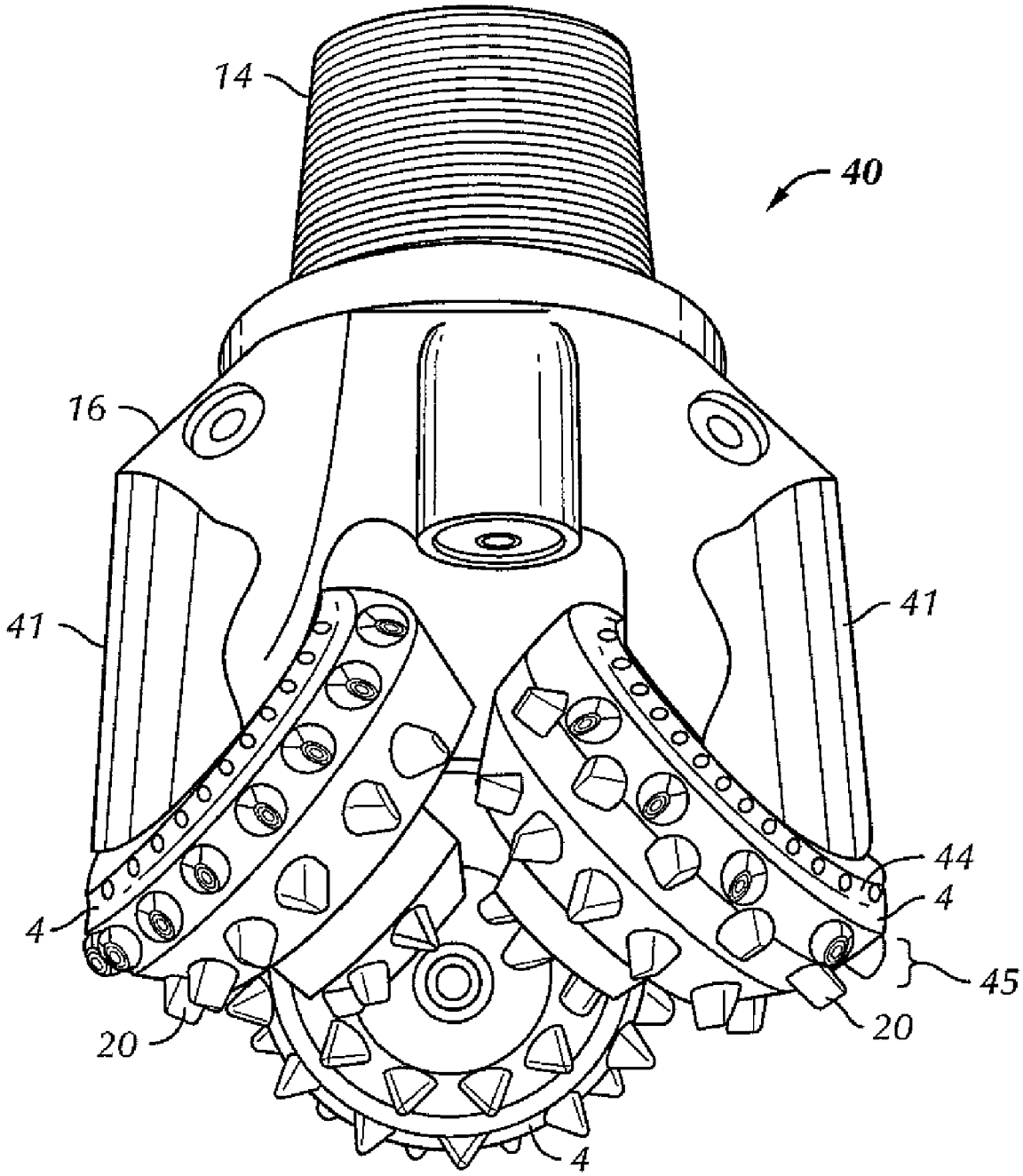
FIG. 4 (Prior Art)
FIG. 4 shows a prior art three cone drill bit.

In one embodiment, the split roller cone may be divided based on cutting rows. For example, the rotational speed of a roller cone is determined by the rotational speed of the bit and the effective radius of the "drive row" of the roller cone. The effective radius is generally related to the radial extent of the cutting elements that extend axially the farthest from the axis of rotation of the cone, these cutting elements generally being located on a so-called "drive row." With reference to FIG. 4, the gage row 45 and the heel row 44 are forced to rotate at the same rotational speed as the drive row. In some cutting configurations, and in various earth formations, the forced rotation by the drive row can cause excessive scraping by the gage row 45 and the heel row 44, which can prematurely wear the cutting elements 20 on the gage row 45 and the heel row 44. In one embodiment, the split roller cone may be divided such that the gage row 45 and the heel row 44 rotate independently of the drive row. As a result, the section that includes the gage row 45 and the heel row 44 may rotate at a more optimal rotational speed for the cutting elements 20 disposed thereon, thus, reducing wear on those cutting elements 20.

In one or more embodiments, a split roller cone may be designed for a drill bit by performing a drilling simulation. The drilling simulation may be performed using one or more of the methods set forth in U.S. patent application Ser. No.

09/524,088 (now U.S. Pat. No. 6,516,293), Ser. No. 09/635,116 (now U.S. Pat. No. 6,873,947), Ser. Nos. 10/749,019, 09/689,299 (now U.S. Pat. No. 6,785,641), Ser. Nos. 10/852,574, 10/851,677, 10/888,358, and 10/888,446, all of which are expressly incorporated by reference in their entirety. The drilling simulation may be used to identify the appropriate location for the intersection of the upper section and the lower section by allowing a designer to locate the wall contact zone and the bottom contact zone. For example, by performing a drilling simulation, cutting elements on the lower section may be arranged such that a selected amount of the cutting elements are in the wall contact zone. In another embodiment, a drilling simulation may be used to balance the work between the upper section and the lower section, such as by adjusting the relative cutting area between the upper section and the lower section.

In one or more embodiments, a split roller cone may be designed for a drill bit by performing drilling tests in a lab environment. For example, in one embodiment, a test sample to be drilled may include two materials having different strengths to simulate a roller cone drill bit drilling through a stringer. Such a test could show at whether the roller cone drill bit stalls at certain drilling parameters (e.g. weight on bit or revolutions per minute). Test data may also be used to improve the location of the intersection(s) between sections of the split roller cone.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A roller cone drill bit comprising:

a bit body configured to be coupled to a drill string;

a journal depending from the bit body;

a split roller cone rotatably attached to the journal, wherein the split roller cone comprises, an upper section, the upper section having a plurality of cutting elements disposed at selected positions thereon, and a lower section, the lower section having a plurality of cutting elements disposed at selected positions thereon, wherein the lower section is able to rotate independently of the upper section; and a seal disposed between the upper section and the lower section.

2. The roller cone drill bit of claim 1, further comprising:

a seal disposed between the upper section and the journal.

3. The roller cone drill bit of claim 1, wherein all of the plurality of cutting elements on the upper section cut in a wall contact zone of the split roller cone.

4. The roller cone drill bit of claim 3, wherein at least one of the plurality of cutting elements on the lower section cuts in the wall contact zone of the split roller cone.

5. The roller cone drill bit of claim 3, wherein none of the plurality of cutting elements on the lower section cuts in the wall contact zone of the split roller cone.

6. The roller cone drill bit of claim 3, wherein the lower section comprises a drive row.

7. The roller cone drill bit of claim 3, wherein the upper section comprises all of the plurality of cutting elements in a gage row and a heel row.

8. The roller cone drill bit of claim 1, further comprising:

a locking mechanism disposed between the journal and the lower section.

9. The roller cone drill bit of claim 8, further comprising:

a locking mechanism disposed between the journal and the upper section.

10. The roller cone drill bit of claim 1, further comprising:

a second journal depending from the bit body; and a second split roller cone rotatably attached to the second journal.

11. The roller cone drill bit of claim 10, further comprising:

a third journal depending from the bit body; and a third split roller cone rotatably attached to the third journal.

12. The roller cone drill bit of claim 1, further comprising:

a second journal depending from the bit body; and a roller cone rotatably attached to the second journal.

13. The roller cone drill bit of claim 12, further comprising:

a third journal depending from the bit body; and a second roller cone rotatably attached to the third journal.

14. The roller cone drill bit of claim 1, wherein the split roller cone further comprises an intermediate section disposed on the journal between the upper section and the lower section.

15. The roller cone drill bit of claim 14, wherein the split roller cone further comprises a second intermediate section disposed on the journal between the upper section and the lower section.

16. The roller cone drill bit of claim 15, wherein each of the lower section, the intermediate section, the second intermediate section, and the upper section comprises a single row of cutting elements.

17. A method of designing a roller cone drill bit, the method comprising:

identifying a wall contact zone and a bottom contact zone of the roller cone drill bit, wherein the roller cone drill bit comprises, a bit body configured to be coupled to a drill string, a journal depending from the bit body, and a split roller cone rotatably attached to the journal, wherein the split roller cone comprises an upper section and a lower section able to rotate independently of each other;

locating an intersection of the upper section and the lower section such that all of a plurality of cutting elements disposed on the upper section cut in the wall contact zone of the split roller cone; and performing a drilling simulation of the roller cone drill bit drilling an earth formation to identify the wall contact zone and the bottom contact zone of the roller cone drill bit.

18. The method of claim 17 further comprising:

arranging a plurality of cutting elements on the lower section such that some of the plurality of cutting elements cut in the wall contact zone and some of the plurality of cutting elements cut in the bottom contact zone.

19. The method of claim 17 further comprising:

performing a lab test of the roller cone drill bit drilling an artificial stringer to determine the location of the intersection of the roller cone drill bit.

* * * * *